US007302869B2

(12) United States Patent
Kamei et al.

(10) Patent No.: US 7,302,869 B2
(45) Date of Patent: Dec. 4, 2007

(54) ELECTRIC STARTER MOTOR

(75) Inventors: Koichiro Kamei, Tokyo (JP); Yoshiyuki Okada, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/205,138

(22) Filed: Aug. 17, 2005

(65) Prior Publication Data

US 2006/0169069 A1 Aug. 3, 2006

(30) Foreign Application Priority Data

Jan. 14, 2005 (JP) ..... 2005-007801

(51) Int. Cl.
*F02N 15/06* (2006.01)

(52) U.S. Cl. ..... 74/6; 74/7 E

(58) Field of Classification Search ..... 74/7 R, 74/7 C, 7 E, 6; 310/83
See application file for complete search history.

(56) References Cited

U.S. PATENT DOCUMENTS 5,237,882 A * 8/1993 Giometti ..... 74/7 A
5,258,674 A * 11/1993 Sakamoto et al. ..... 310/83
5,265,485 A * 11/1993 Sakamoto et al. ..... 74/7 E
5,622,148 A * 4/1997 Xue et al. ..... 123/179.25
5,684,334 A * 11/1997 Zenmei et al. ..... 290/38 R
5,706,699 A * 1/1998 Moribayashi ..... 74/7 A
5,743,139 A * 4/1998 Murata ..... 74/7 E
6,177,533 B1 * 1/2001 Woodward ..... 526/255
6,239,503 B1 * 5/2001 Ikeda et al. ..... 290/38 R
6,647,812 B2 * 11/2003 Nito et al. ..... 74/6

FOREIGN PATENT DOCUMENTS

JP A 2002-180937 6/2002
JP A 2003-239834 8/2003

* cited by examiner

*Primary Examiner*—Richard Ridley
*Assistant Examiner*—James Pilkington
(74) *Attorney, Agent, or Firm*—Sughrue Mion, PLLC

(57) ABSTRACT

A pinion includes: a first pinion flange portion disposed so as to protrude radially at a front end of a pinion boss portion; and a second pinion flange portion disposed so as to protrude radially facing the first pinion flange portion from an opposite side of the pinion boss portion. A movement linking body includes: first and second engaging recess portions fitting together with the pinion boss portion and an intermediate gear boss portion; a first sliding surface coming into contact with the first pinion flange portion, the first sliding surface restricting rearward movement of the pinion; a second sliding surface coming into contact with a front-end end surface of the second pinion flange portion, the second sliding surface restricting forward movement of the pinion; and a third sliding surface coming into contact with the clutch cover, the third sliding surface restricting forward movement of the pinion.

10 Claims, 3 Drawing Sheets

ELECTRIC STARTER MOTOR

BACKGROUND OF THE INVENTION

1. Field of the Invention

The present invention relates to an electric starter motor having an intermediate gear that constantly intermeshes with a pinion, the electric starter motor transmitting torque imparted by an output shaft of an electric motor from the pinion through the intermediate gear to a ring gear.

2. Description of the Related Art

Conventional electric starter motors include: an output shaft for imparting torque; a pinion disposed on the output shaft so as to be movable axially, rotation of the output shaft being transmitted to rotate the pinion; an intermediate shaft disposed parallel to the output shaft; an intermediate gear intermeshing with the pinion, the intermediate gear being rotatably supported by the intermediate shaft, and also being disposed on the intermediate shaft so as to be movable axially; and an anchoring member engaging with a pinion boss portion disposed on the pinion and a cylindrical boss portion disposed on the intermediate gear so as to be rotatable relative to each other, the anchoring member restricting relative axial movement between the pinion and the intermediate gear. When starting an internal combustion engine, the intermediate gear is moved axially with the pinion by means of the anchoring member so as to be engaged with a ring gear of the internal combustion engine. Thus, torque imparted by the output shaft is transmitted from the pinion through the intermediate gear to the ring gear to start the engine. (See Patent Literature 1, for example.)

Patent Literature 1: Japanese Patent Laid-Open No. 2002-180937 (Gazette)

In conventional electric starter motors, the anchoring member (corresponding to the movement linking body of the present invention) is positioned between a pinion flange portion and a clutch cover, and restricts axial movement of the pinion. Since it is necessary to permit relative rotation of the pinion and the intermediate gear, it is necessary to make the thickness of the anchoring member slightly smaller than a dimension between the pinion flange portion and the clutch cover. Specifically, it is necessary to dispose some clearance between the anchoring member and the clutch cover when the anchoring member is in contact with the pinion flange portion.

Now, the clutch cover is mounted so as to be fitted over a clutch outer with a washer interposed. Thus, in addition to dimensional precision of the pinion, the dimension between the pinion flange portion and the clutch cover is affected by sheet thickness of the washer and the clutch cover, and also by flatness of the washer and the clutch cover. In addition, there may also be irregularities in the thickness of the anchoring member. From these points, it is necessary to predesign the dimension between the pinion flange portion and the clutch cover so as to have a comparatively large dimension.

Since the pinion and the clutch cover and the anchoring member rotate relative to each other while the electric starter motor is operating, the sliding surfaces of the anchoring member relative to the pinion flange portion and the clutch cover are abraded with repeated use, further increasing the clearance between the anchoring member and the clutch cover. Thus, the intermediate gear may have too much play.

SUMMARY OF THE INVENTION

The present invention aims to solve the above problems and an object of the present invention is to provide an electric starter motor enabling play of an intermediate gear to be kept to a minimum.

In order to achieve the above object, according to one aspect of the present invention, there is provided an electric starter motor including: an electric motor; an output shaft to which torque is imparted by the electric motor; an overrunning clutch including: a clutch outer coupled to the output shaft by a spline; a clutch inner disposed inside the clutch outer; a roller disposed between the clutch outer and the clutch inner, the roller transmitting torque from the clutch outer to the clutch inner; a washer mounted to an open end of the clutch outer, the washer restricting axial movement of the roller; and a clutch cover mounted so as to be fitted over the clutch outer, the clutch cover fixing the washer to an end surface of the open end of the clutch outer; a pinion disposed integrally on the clutch inner so as to be movable axially and rotatable on the output shaft; an intermediate shaft disposed parallel to the output shaft; an intermediate gear intermeshing with the pinion, the intermediate gear being disposed so as to be rotatably supported by the intermediate shaft and movable axially on the intermediate shaft; and a movement linking body engaging with a cylindrical pinion boss portion disposed on the pinion and a cylindrical intermediate gear boss portion disposed on the intermediate gear such that each is rotatable relatively, the movement linking body restricting relative axial movement of the pinion and the intermediate gear. The electric starter motor moves the intermediate gear axially forward together with the pinion by means of the movement linking body during starting of an engine to intermesh the intermediate gear with a ring gear and start the engine, and moves the intermediate gear axially rearward together with the pinion by means of the movement linking body after the engine has been started to release the intermeshing of the intermediate gear with the ring gear. In addition, the pinion includes: a first pinion flange portion disposed so as to protrude radially at a front end of the pinion boss portion; and a second pinion flange portion disposed so as to protrude radially facing the first pinion flange portion from an opposite side of the pinion boss portion. The movement linking body includes: first and second engaging recess portions fitting together with the pinion boss portion and the intermediate gear boss portion; a first sliding surface coming into contact with the first pinion flange portion, the first sliding surface restricting rearward movement of the pinion; a second sliding surface coming into contact with the second pinion flange portion, the second sliding surface restricting forward movement of the pinion; and a third sliding surface coming into contact with the clutch cover, the third sliding surface restricting forward movement of the pinion.

According to the present invention, a second pinion flange portion is disposed on a pinion, and a second sliding surface coming into contact with this second pinion flange portion to restrict forward movement of the pinion is disposed on a movement linking body. In addition, a third sliding surface coming into contact with a clutch cover to restrict forward movement of the pinion is disposed on the movement linking body.

Parts constituting a second clearance $\Delta_2$ between the clutch cover and the third sliding surface are the pinion, the movement linking body, a washer, and the clutch cover. On the other hand, parts constituting a first clearance $\Delta_1$ between the second pinion flange portion and the second sliding surface are the pinion and the movement linking body. Thus, because this first clearance $\Delta_1$ can be designed with consideration for only dimensional irregularity of the pinion and thickness irregularity of the movement linking body, the first clearance $\Delta_1$ can be made less than the second clearance $\Delta_2$. Because play of the intermediate gear is determined by the first clearance $\Delta_1$, initial play of the intermediate gear can be kept to a minimum.

In addition, if the second sliding surface slides in contact with the second pinion flange portion with repeated use and is abraded by a predetermined amount, the third sliding surface comes into contact with the clutch cover. At this point in time, because the third sliding surface comes into contact with the clutch cover with the second sliding surface still in contact with the second pinion flange portion, the abrasion surface area of the movement linking body increases, and the abrasion rate becomes more gradual, enabling the play of the intermediate gear to be kept to a minimum for a long time.

DETAILED DESCRIPTION OF THE PREFERRED EMBODIMENTS

Preferred embodiments of the present invention will now be explained with reference to the drawings.

Embodiment 1

Figure 1:
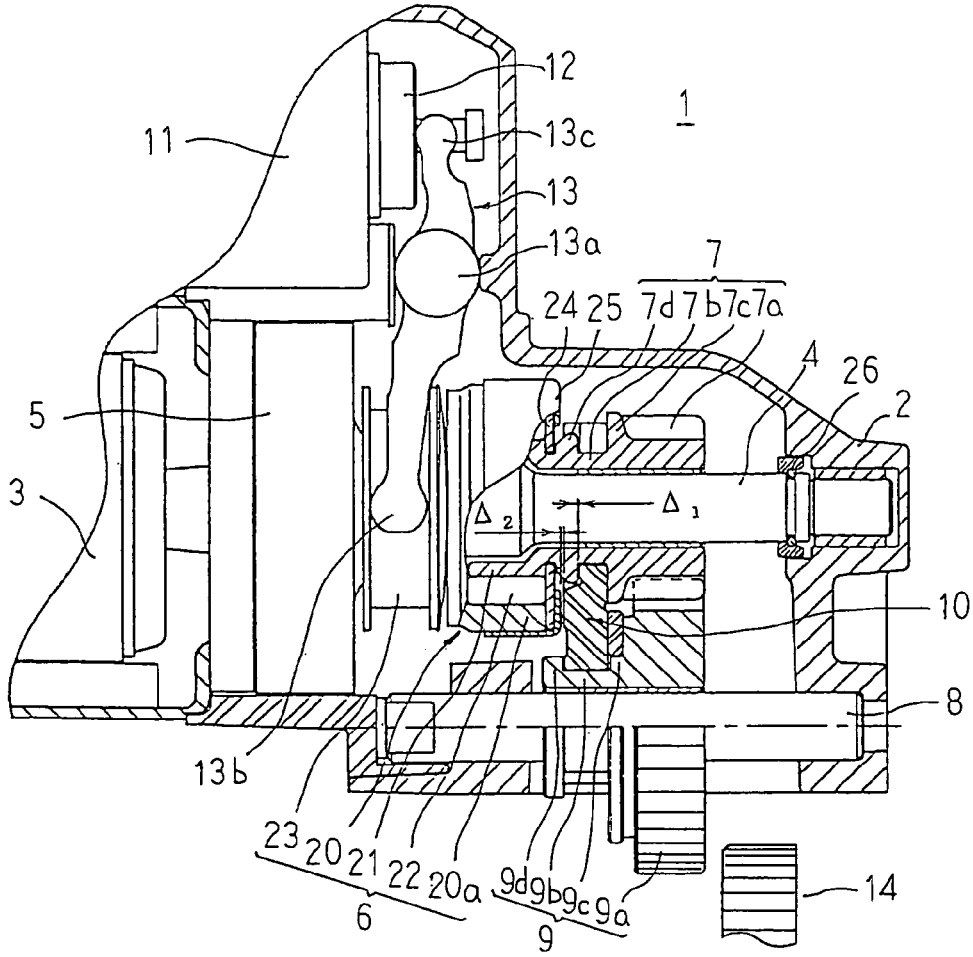
FIG. 1 is a partial cross section showing an electric starter motor according to Embodiment 1 of the present invention.
Figure 2A:
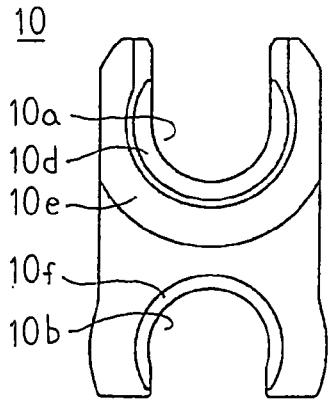
FIG. 2A is a rear elevation explaining a configuration of a movement linking body used in the electric starter motor according to Embodiment 1 of the present invention.
Figure 2B:
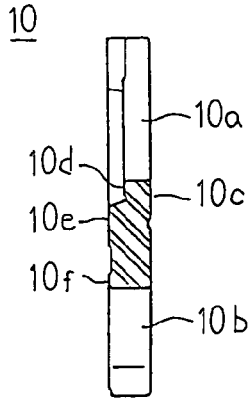
FIG. 2B is a cross section explaining the configuration of the movement linking body used in the electric starter motor according to Embodiment 1 of the present invention.

FIG. 1 is a partial cross section showing an electric starter motor according to Embodiment 1 of the present invention. FIGS. 2A and 2B are diagrams explaining a configuration of a movement linking body used in the electric starter motor according to Embodiment 1 of the present invention, FIG. 2A showing a rear elevation and FIG. 2B showing a cross section.

In FIG. 1, an electric starter motor 1 is constituted by: an electric motor 3 for generating torque; a planetary reduction assembly 5 for outputting rotation of the electric motor 3 so as to be reduced in speed; an overrunning clutch 6 fitting together with an output shaft 4 of the planetary reduction assembly 5; a pinion 7 disposed integrally on the overrunning clutch 6 so as to be slidable axially on the output shaft 4; an intermediate shaft 8 disposed axially parallel to the output shaft 4; an intermediate gear 9 disposed so as to be slidable axially and rotatable on the intermediate shaft 8, the intermediate gear being constantly intermeshed with the pinion 7; a movement linking body 10 for restricting relative axial movement between the pinion 7 and the intermediate gear 9; an electromagnetic switch 11 for controlling passage of electric current to the electric motor 3 and also for forcing the pinion 7 together with the overrunning clutch 6 toward a ring gear 14 of an engine by means of a shift lever 13, etc.

The electric motor 3 is a direct-current motor, and when an energizing circuit (not shown) of the electric motor 3 is closed using the electromagnetic switch 11, current is supplied by a vehicle battery (not shown) to generate torque in an internal armature (not shown). The output shaft 4 is linked coaxially with a rotating shaft (not shown) of the electric motor 3 by means of the planetary reduction assembly 5, and outputs rotational power reduced in speed by the planetary reduction assembly 5.

The overrunning clutch 6 is constituted by: a thrust spline 20 mounted to the output shaft 4 such that axial movement is possible and rotational motion is transmitted; a clutch inner 21; rollers 22 for transmitting the rotational motion of the thrust spline 20 to the clutch inner 21; a spacing collar 23 fixed to a rear end of the thrust spline 20 (near the electric motor), engaging with a first end 13*b* of the shift lever 13, and transmitting a pivoting force from the shift lever 13 to the thrust spline 20, etc.

The thrust spline 20 has a construction in which a boss portion (not shown) coupled by a helical spline to the output shaft 4, a cam bottom portion (not shown), and a clutch outer 20*a* are formed integrally such that an end near the pinion 7 is open. The clutch outer 20*a* has a wedge-shaped profile in which a plurality of notches each forming a wedge-shaped circumferential shape that gradually diminishes in a first circumferential direction and having an axially-uniform inside diameter are disposed so as to extend axially at a uniform angular pitch on an inner peripheral surface.

An outer peripheral surface of the clutch inner 21 is formed so as to have a cylindrical shape having an axially-uniform outside diameter, and the pinion 7 which transmits power to the ring gear 14 is formed integrally on a front end of the clutch inner 21 (near the ring gear 14). This clutch inner 21 is mounted to the output shaft 4 so as to be movable axially and rotatable, a rear end of the clutch inner 21 is disposed inside the clutch outer 20*a*, and wedge-shaped spaces are formed between an outer peripheral surface of the clutch inner 21 and the notches of the clutch outer 20*a*.

The rollers 22 are housed inside each of the wedge-shaped spaces formed by the clutch outer 20*a* and the clutch inner 21 so as to be movable circumferentially, and compressed springs (not shown) for forcing the rollers 22 toward narrow portions of the wedge-shaped spaces are also housed therein. A washer 24 is also disposed at the open end of the clutch outer 20*a* to restrict axial movement of the rollers 22. In addition, a clutch cover 25 is mounted so as to be fitted over the clutch outer 20*a* from the open end of the clutch outer 20*a* to fix the washer 24 to the open end of the clutch outer 20*a*.

A stopper 26 is also mounted to a front end of the output shaft 4 to prevent the clutch inner 21 (the pinion 7) from contacting a front bracket 2.

The pinion 7 is formed integrally on the front end of the clutch inner 21, and is mounted to the output shaft 4 so as to be movable axially and rotatable. A pinion toothed portion 7*a* is disposed on a portion at a front end of the pinion 7, and a cylindrical pinion boss portion 7*b* is disposed on a portion at a rear end of the pinion 7. In addition, first and second pinion flange portions 7*c* and 7*d* are disposed so as to protrude radially from positions at first and second axial ends of the pinion boss portion 7*b*. Facing surfaces of the first and second pinion flange portions 7*c* and 7*d* are formed so as to have a flat surface perpendicular to an axial direction. The flat surface of the second pinion flange portion 7*d* perpendicular to the axial direction is positioned nearer to the front end than a front-end end surface of the clutch cover 25.

The intermediate gear 9 is disposed on the intermediate shaft 8 so as to be movable axially and rotatable on the intermediate shaft 8, and is constantly engaged with the pinion 7. An intermediate gear toothed portion 9*a* engaging with the pinion toothed portion 7*a* is disposed on a portion at a front end of the intermediate gear 9, and a cylindrical intermediate gear boss portion 9*b* is disposed on a portion at a rear end of the intermediate gear 9. In addition, first and second intermediate gear flange portions 9*c* and 9*d* are disposed so as to protrude radially from positions at first and second axial ends of the intermediate gear boss portion 9*b*. Facing surfaces of the first and second intermediate gear flange portions 9*c* and 9*d* are formed so as to have a flat surface perpendicular to an axial direction. When the position of the flat surface of the first intermediate gear flange portion 9*c* perpendicular to the axial direction is aligned relative to the axial direction with the position of the flat surface of the first pinion flange portion 7*c* perpendicular to the axial direction, the intermediate gear toothed portion 9*a* intermeshes with the pinion toothed portion 7*a*.

The movement linking body 10 is a resin-molded body formed into a generally rectangular parallelepiped shape having a predetermined thickness in an axial direction and, as shown in FIG. 2, has a first interfitting recess portion 10*a* having a U-shaped cross section fitting together with the pinion boss portion 7*b* and a second interfitting recess portion 10*b* having a U-shaped cross section fitting together with the intermediate gear boss portion 9*b*, formed so as to be separated with opening portions facing outward. A front-end end surface of the movement linking body 10 is formed so as to have a flat surface perpendicular to the axial direction constituting a first sliding surface 10*c* for restricting rearward movement of the pinion 7 and the intermediate gear 9 by engaging with the first pinion and intermediate gear flange portions 7*c* and 9*c*. A rear-end outer peripheral edge portion of the first interfitting recess portion 10*a* is formed so as to have a flat surface perpendicular to the axial direction constituting a second sliding surface 10*d* for restricting forward movement of the pinion 7 by engaging with the second pinion flange portion 7*d*. In addition, an outer peripheral edge portion of the second sliding surface 10*d* is formed so as to have a flat surface perpendicular to the axial direction constituting a third sliding surface 10*e* for restricting forward movement of the overrunning clutch 6 by engaging with the clutch cover 25 of the overrunning clutch 6. A rear-end outer peripheral edge portion of the second interfitting recess portion 10*b* is formed so as to have a flat surface perpendicular to the axial direction constituting a fourth sliding surface 10*f* for restricting forward movement of the intermediate gear 9 by engaging with the second intermediate gear flange portion 9*d*. A width of the opening portion of the second interfitting recess portion 10*b* is formed so as to be slightly smaller than a diameter of the intermediate gear boss portion 9*b*.

A distance (thickness) between the first sliding surface 10*c* and the second sliding surface 10*d* is configured so as to be generally equal to a distance between the first and second pinion flange portions 7*c* and 7*d*. A distance (thickness) between the first sliding surface 10*c* and the third sliding surface 10*e* is configured so as to be generally equal to a distance between the first pinion flange portion 7*c* and the front-end end surface of the clutch cover 25. In addition, a distance (thickness) between the first sliding surface 10*c* and the fourth sliding surface 10*f* is configured so as to be generally equal to a distance between the first and second intermediate gear flange portions 9*c* and 9*d*. Moreover, a thickness between the first sliding surface 10*c* and the second sliding surface 10*d* and a thickness between the first sliding surface 10*c* and the third sliding surface 10*e*, as described below, are configured such that even in the worst case a first clearance $\Delta_1$ is present between the second sliding surface 10*d* and the second pinion flange portion 7*d* and a second clearance $\Delta_2$ is present between the third sliding surface 10*e* and the front-end end surface of the clutch cover 25.

This movement linking body 10 is mounted by fitting the first interfitting recess portion 10*a* onto the pinion boss portion 7*b* and fitting the second interfitting recess portion 10*b* onto in the intermediate gear boss portion 9*b* of the intermediate gear 9 with the pinion and intermediate gear toothed portions 7*a* and 9*a* intermeshed with each other. Thus, the intermediate gear 9 is movable axially interdependently with the axial movement of the pinion 7 by means of the movement linking body 10. In other words, relative axial movement between the pinion 7 and the intermediate gear 9 is restricted by means of the movement linking body 10. The intermediate gear 9 and the pinion 7 are rotatable relative to the movement linking body 10. In addition, because the width of the opening portion of the second interfitting recess portion 10*b* is formed so as to be slightly smaller than a diameter of the intermediate gear boss portion 9*b*, the intermediate gear boss portion 9*b* can be fitted inside the second interfitting recess portion 10*b* by elastically deforming the two segments constituting the opening portion of the second interfitting recess portion 10*b*. Thus, the movement linking body 10 will not disengage from the intermediate gear boss portion 9*b*, improving mounting of the movement linking body 10.

The electromagnetic switch 11 is positioned on an outer periphery of the electric motor 3 and the planetary reduction assembly 5, a central axis of the electromagnetic switch 11 being disposed generally parallel to the output shaft 4. This electromagnetic switch 11 is configured such that a plunger 12 is attracted magnetically when subjected to the passage of an electric current, and the plunger 12 is pushed back by a return spring (not shown) when the passage of electric current is released so as to open and close an energizing circuit of the electric motor 3.

The shift lever 13 is mounted so as to be pivotable around an intermediate supporting point portion 13*a*, a first end 13*b* of the shift lever 13 is engaged in the spacing collar 23 of the overrunning clutch 6, and a second end 13*c* of the shift lever 13 is coupled to the plunger 12 of the electromagnetic switch 11 mounted above the electric motor 3.

Next, action of an electric starter motor 1 configured in this manner will be explained.

When a key switch (not shown) is closed, an electric current is passed through the electromagnetic switch 11, magnetically attracting the plunger 12. Thus, the plunger 12 moves left in FIG. 1 (rearward). Accompanying this movement of the plunger 12, the shift lever 13 pivots counterclockwise in FIG. 1 with the supporting point portion 13*a* as a pivoting axis. Due to this pivoting of the shift lever 13, the first end 13*b* of the shift lever 13 presses the spacing collar 23 forward. Thus, the overrunning clutch 6 is pressed forward, and the overrunning clutch 6 and the pinion 7 move forward together on the output shaft 4. The motive force of the pinion 7 is transmitted to the intermediate gear 9 through the movement linking body 10, moving the intermediate gear 9 forward on the intermediate shaft 8. Then, when the end surface of the intermediate gear 9 comes into contact with the end surface of the ring gear 14, the movement of the overrunning clutch 6, the pinion 7, and the intermediate gear 9 stops.

Next, the energizing circuit of the electric motor 3 is closed while compressing a lever spring (not shown) inside the electromagnetic switch 11. Thus, electric current is supplied to the electric motor 3 by the vehicle battery, generating torque in the armature of the electric motor 3. This torque is reduced in speed by the planetary reduction assembly 5, and transmitted to the output shaft 4.

With rotation of the output shaft 4, the pinion 7 rotates, and the intermediate gear 9 rotates simultaneously. Then, when the contact position of the intermediate gear 9 on the ring gear 14 is offset to a position enabling intermeshing, stored energy in the lever spring inside the electromagnetic switch 11 is released and the overrunning clutch 6 and the pinion 7 are pushed out and forward. The forward moving force of the pinion 7 is transmitted to the intermediate gear 9 through the movement linking body 10, moving the intermediate gear 9 forward, and the intermediate gear 9 intermeshes with the ring gear 14. At that time, the pinion 7 comes into contact with the stopper 26, avoiding collision with the front bracket 2. Thus, rotational torque from the output shaft 4 is transmitted to the ring gear 14, driving the engine.

The engine is ignited, then the supply of electric current to the electromagnetic switch 11 is stopped when the key switch is switched off. Thus, magnetic attraction no longer acts on the plunger 12, and the plunger 12 is returned forward by the stored energy of a return spring (not shown). Accompanying this movement of the plunger 12, the shift lever 13 pivots clockwise in FIG. 1 with the supporting point portion 13*a* as a pivoting axis. Due to this pivoting of the shift lever 13, the first end 13*b* of the shift lever 13 presses the spacing collar 23 rearward. Thus, the overrunning clutch 6 is pressed rearward, and the overrunning clutch 6 and the pinion 7 move rearward together on the output shaft 4. The motive force of the pinion 7 is transmitted to the intermediate gear 9 through the movement linking body 10, moving the intermediate gear 9 rearward on the intermediate shaft 8. Thus, intermeshing between the intermediate gear 9 and the ring gear 14 is released, and the rear-end end surface of a boss portion (not shown) of the thrust spline 20 comes into contact with a stepped portion (not shown) disposed on the output shaft 4, returning to a static position (initial position).

Next, the play suppressing effects of the intermediate gear according to Embodiment 1 will be explained by making a comparison with a comparative example.

Figure 3:
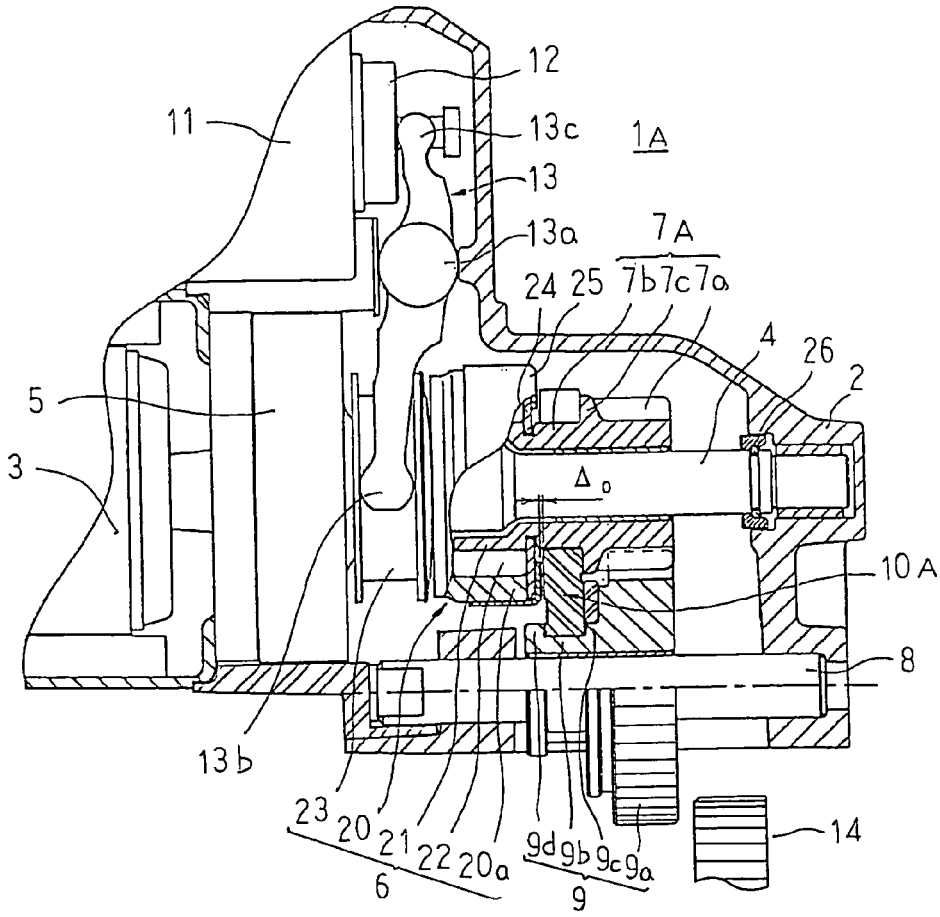
FIG. 3 is a partial cross section showing an electric starter motor functioning as a comparative example.
Figure 4A:
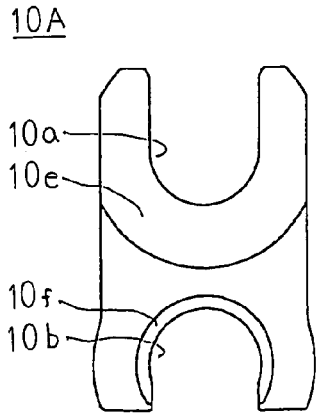
FIG. 4A is a rear elevation explaining a configuration of a movement linking body used in the electric starter motor functioning as a comparative example.
Figure 4B:
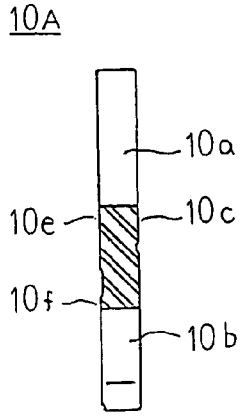
FIG. 4B is a cross section explaining the configuration of the movement linking body used in the electric starter motor functioning as a comparative example.

First, a construction of a comparative example electric starter motor 1A will be explained with reference to FIGS. 3 and 4.

In the comparative example, a pinion 7A is configured in a similar manner to that of the pinion 7 according to Embodiment 1 except for the fact that a second pinion flange portion 7*d* is omitted. A movement linking body 10A is a resin-molded body formed into a generally rectangular parallelepiped shape having a predetermined thickness in an axial direction and has a first interfitting recess portion 10*a* and a second interfitting recess portion 10*b* formed so as to be separated with opening portions facing outward. A front surface of this movement linking body 10A constitutes a first sliding surface 10*c* engaging with a first pinion flange portion 7*c* of the pinion 7A and a first intermediate gear flange portion 9*c* of an intermediate gear 9. A rear-end outer peripheral edge portion of the first interfitting recess portion 10*a* constitutes a third sliding surface 10*e* engaging with a clutch cover 25 of an overrunning clutch 6. In addition, a rear-end outer peripheral edge portion of the second interfitting recess portion 10*b* constitutes a fourth sliding surface 10*f* engaging with a second intermediate gear flange portion 9*d* of the intermediate gear 9. This movement linking body 10A is configured in a similar manner to that of the movement linking body 10 according to Embodiment 1 except for the fact that a second sliding surface is omitted.

This movement linking body 10A is mounted by fitting the first interfitting recess portion 10*a* onto the pinion boss portion 7*b* and fitting the second interfitting recess portion 10*b* onto in the intermediate gear boss portion 9*b* of the intermediate gear 9 with the pinion and intermediate gear toothed portions 7*a* and 9*a* intermeshed with each other. The movement linking body 10A engages with the first pinion flange portion 7*c* and a front-end end surface of the clutch cover 25 to restrict axial movement of the pinion 7A.

Moreover, the rest of the comparative example is configured in a similar manner to that of the electric starter motor 1 according to Embodiment 1.

In this comparative example, the movement linking body 10A is positioned between the front-end end surface of the clutch cover 25 and the first pinion flange portion 7*c* to restrict relative axial movement of the pinion 7A and the intermediate gear 9 and to permit relative rotation of the pinion 7A and the intermediate gear 9. Thus, some clearance is required between the movement linking body 10A and the front-end end surface of the clutch cover 25.

Thus, in consideration of irregularities of the dimensional precision of each of the parts constituting the clearance in question, it is necessary to configure the movement linking body 10A such that a clearance is formed even in the worst case.

The parts constituting the clearance in question include: the pinion 7A, the movement linking body 10A, the washer 24, and the clutch cover 25. Thus, in addition to the dimensional precision of the pinion 7A and the movement linking body 10A, it is necessary to consider thickness precision of the washer 24 and the clutch cover 25, and also flatness of the washer 24 and the clutch cover 25, and a comparatively large clearance must be formed. Consequently, the play of the intermediate gear 9 is large from an initial state. In addition, if the movement linking body 10A is abraded with repeated use, the play of the intermediate gear 9 becomes even larger.

In this comparative example, in order to configure the movement linking body 10A such that a clearance is formed even in the worst case, $$\Delta_0 \min = \Delta_0 - (\delta_1 + \delta_2 + \delta_3 + \delta_4 + \delta_5 + \delta_6) > 0$$

must be satisfied.

In other words, $\Delta_0 > (\delta_1 + \delta_2 + \delta_3 + \delta_4 + \delta_5 + \delta_6)$ must be satisfied.

Moreover, $\Delta_0$ is an initial clearance between a front-end end surface of a clutch cover and a movement linking body, $\delta_1$ is a thickness irregularity of the movement linking body, $\delta_2$ is a dimensional irregularity of a pinion, $\delta_3$ is a dimensional irregularity of a washer, $\delta_4$ is a flatness irregularity of the washer, $\delta_5$ is a dimensional irregularity of a clutch cover, and $\delta_6$ is a flatness irregularity of the clutch cover.

On the other hand, in Embodiment 1, the movement linking body 10 is positioned between the first and second pinion flange portions 7*c* and 7*d*, and is also positioned between the front-end end surface of the clutch cover 25 and the first pinion flange portion 7*c*, to restrict relative axial movement of the pinion 7 and the intermediate gear 9.

The parts constituting the first clearance $\Delta_1$ between the second sliding surface 10*d* and the second pinion flange portion 7*d* are the pinion 7 and the movement linking body 10. Thus, in order to configure the movement linking body 10 such that the first clearance $\Delta_1$ between the second sliding surface 10*d* and the second pinion flange portion 7*d* is present even in the worst case, it is sufficient if $\Delta_1 min=\Delta_1-(\delta_1+\delta_2)>0$. In other words, it is sufficient if $\Delta_1>(\delta_1+\delta_2)$.

The parts constituting the second clearance $\Delta_2$ between the third sliding surface 10*e* and the second pinion flange portion 7*d* are the pinion 7, the movement linking body 10, the washer 24, and the clutch cover 25. Thus, in order to configure the movement linking body 10 such that the second clearance $\Delta_2$ between the third sliding surface 10*e* and the second pinion flange portion 7*d* is present even in the worst case, it is sufficient if $\Delta_2 min=\Delta_2-(\delta_1+\delta_2+\delta_3+\delta_4+\delta_5+\delta_6)>0$. In other words, it is sufficient if $\Delta_2>(\delta_1+\delta_2+\delta_3+\delta_4+\delta_5+\delta_6)$. Moreover, the first clearance $\Delta_1$<the second clearance $\Delta_2$=the initial clearance $\Delta_0$.

Consequently, in Embodiment 1, the play of the intermediate gear 9 can be reduce initially compared to the comparative example by restricting the first clearance $\Delta_1$.

If the movement linking body 10 is abraded with repeated use, the third sliding surface 10*e* engages with the front-end end surface of the clutch cover 25. At that point in time, the play of the intermediate gear 9 is restricted by the second clearance $\Delta_2$. Thus, even with repeated use, the play of the intermediate gear 9 can be reduced compared to the comparative example.

In that state, the second sliding surface 10*d* engages with the second pinion flange portion 7*d*, and the third sliding surface 10*e* is also engaged with the front-end end surface of the clutch cover 25. Thus, because the abrasion surface area of the movement linking body 10 is increased compared to the comparative example, the abrasion rate is more gradual than for the comparative example. The play of the intermediate gear 9 can thereby be kept to a minimum even with sustained use.

Figure 5:
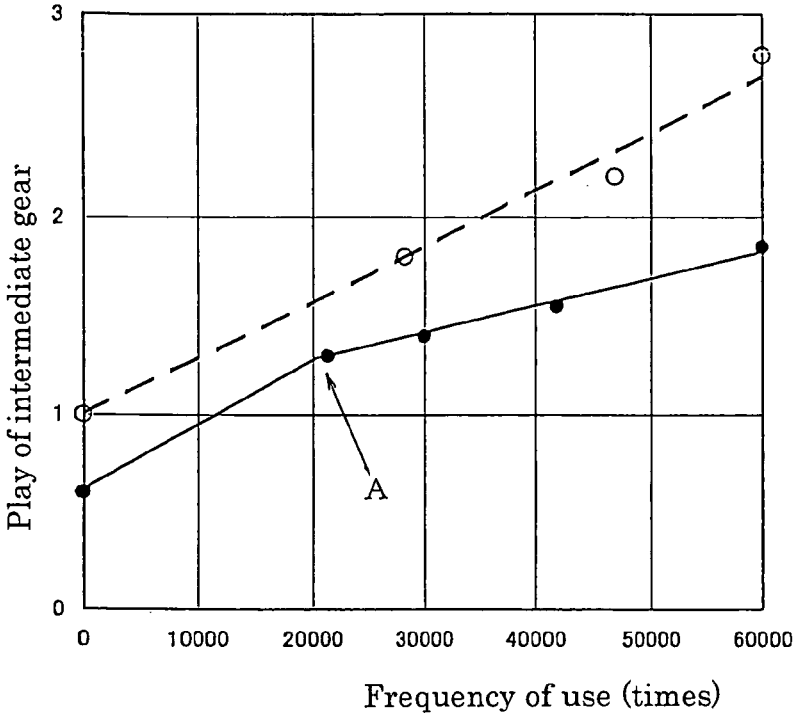
FIG. 5 is a graph showing a relationship between play of an intermediate gear and frequency of use in the electric starter motor according to Embodiment 1 of the present invention.

FIG. 5 is a graph showing a relationship between frequency of use and play of an intermediate gear in the electric starter motor according to Embodiment 1 of the present invention. Moreover, a solid line represents Embodiment 1, and a broken line represents the comparative example. The vertical axis represents initial play of the intermediate gear according to the comparative example as 1. Point A is the point when the third sliding surface 10*e* and the front-end end surface of the clutch cover 25 first come into contact with each other.

As can be seen from FIG. 5, the play of the intermediate gear in the comparative configuration gradually increases as the frequency of use increases.

On the other hand, it can be seen that in the configuration of Embodiment 1 the play of the intermediate gear is initially smaller than that of the comparative example. It can be inferred that this is an effect resulting from disposing the second pinion flange portion 7*d* on the pinion 7 to engage the second sliding surface 10*d*.

It can also be seen that after the third sliding surface 10*e* and the front-end end surface of the clutch cover 25 first come into contact with each other, the rate of increase in play of the intermediate gear decreases. It can be inferred that this is an effect resulting from the abrasion surface area of the movement linking body 10 increasing.

Moreover, the first and fourth sliding surfaces 10*c* and 10*f* are abraded by rotating relative to the first and second intermediate gear flange portions 9*c* until the third sliding surface 10*e* comes into contact with the front-end end surface of the clutch cover 25, increasing the clearance between the intermediate gear 9 and the movement linking body 10. Thus, at point A, the play of the intermediate gear 9 according to Embodiment 1 becomes greater than the initial play of the comparative example due to the additional influence of the increased clearance between the intermediate gear 9 and the movement linking body 10.

In Embodiment 1, because the movement linking body 10 is a resin-molded body, manufacturing of the movement linking body 10 is facilitated.

Here, since the electric starter motor 1 is installed inside an engine compartment, the movement linking body 10 is required to have a predetermined strength and a heat tolerance greater than or equal to 150 degrees Celsius, and resins such as nylons, polyacetal (POM), polybutylene terephthalate (PBT), polyphenylene sulfide (PPS), polyethersulfone (PES), polyetheretherketone (PEEK), etc., are used in the movement linking body 10. Since nylons have superior abrasion resistance in addition to heat tolerance, a nylon is preferable as the material for the movement linking body 10.

In addition, the movement linking body 10 may also be molded using a resin such as a nylon, for example, to which has been added a lubricant having a low friction coefficient constituted by at least one material selected from a group including carbon fibers, polytetrafluoroethylene (PTFE), etc. In that case, because lubricity of the movement linking body 10 is increased, friction between the movement linking body 10 and the pinion, the clutch cover, and the intermediate gear is reduced. Thus, abrasion of the movement linking body 10 is reduced, reducing the play of the intermediate gear.

Embodiment 2

Figure 6A:
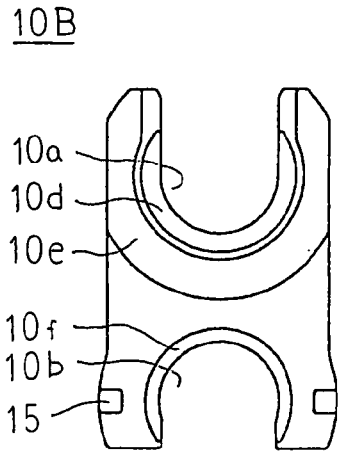
FIG. 6A is a rear elevation explaining a configuration of a movement linking body used in an electric starter motor according to Embodiment 2 of the present invention.
Figure 6B:
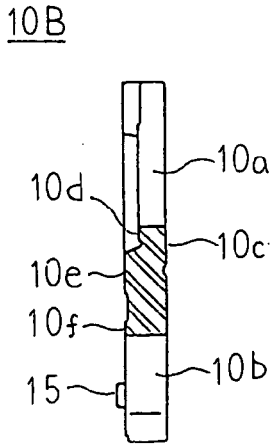
FIG. 6B is a cross section explaining the configuration of the movement linking body used in the electric starter motor according to Embodiment 2 of the present invention.

FIGS. 6A and 6B are diagrams explaining a configuration of a movement linking body used in the electric starter motor according to Embodiment 2 of the present invention, FIG. 6A showing a rear elevation and FIG. 6B showing a cross section.

In FIGS. 6A and 6B, lugs 15 for preventing incorrect assembly are disposed so as to protrude from first and second sides of an opening portion of a second interfitting recess portion 10*b* on a rear-end surface of a movement linking body 10B.

Moreover, the rest of this embodiment is configured in a similar manner to Embodiment 1 above.

In Embodiment 2, if an attempt is made to fit the second interfitting recess portion 10*b* onto the intermediate gear boss portion 9*b* with the movement linking body 10B facing in a reverse direction, the lugs 15 interfere, preventing mounting. Because the movement linking body 10B is a resin-molded body, the lugs 15 can be formed integrally on the movement linking body 10B during resin molding.

Thus, in Embodiment 2, in addition to the effects of Embodiment 1 above, an inexpensive movement linking body 10B can be obtained enabling incorrect assembly to be reliably prevented by a simple configuration without adding new parts.

Moreover, in each of the above embodiments, the sliding surface of the movement linking body 10 or 10B coming into contact with the first pinion flange portion 7*c* and the first intermediate gear flange portion 9*c* is constituted by a single first sliding surface 10*c*, but a sliding surface coming into contact with the first pinion flange portion 7*c* and a sliding surface coming into contact with the first intermediate gear flange portion 9*c* may also be formed separately on the movement linking body 10 or 10B by changing respective axial positions thereof.

What is claimed is:

1. An electric starter motor comprising:

an electric motor;

an output shaft to which torque is imparted by said electric motor;

an overrunning clutch comprising:

a clutch outer coupled to said output shaft by a spline;

a clutch inner disposed inside said clutch outer;

a roller disposed between said clutch outer and said clutch inner, said roller transmitting torque from said clutch outer to said clutch inner;

a washer mounted to an open end of said clutch outer, said washer restricting axial movement of said roller; and a clutch cover mounted so as to be fitted over said clutch outer, said clutch cover fixing said washer to an end surface of said open end of said clutch outer;

a pinion disposed integrally on said clutch inner so as to be movable axially and rotatable on said output shaft;

an intermediate shaft disposed parallel to said output shaft;

an intermediate gear intermeshing with said pinion, said intermediate gear being disposed so as to be rotatably supported by said intermediate shaft and movable axially on said intermediate shaft; and a movement linking body engaging with a cylindrical pinion boss portion disposed on said pinion and a cylindrical intermediate gear boss portion disposed on said intermediate gear such that each is rotatable relatively, said movement linking body restricting relative axial movement of said pinion and said intermediate gear, said electric starter motor moving said intermediate gear axially forward together with said pinion by means of said movement linking body during starting of an engine to intermesh said intermediate gear with a ring gear and start an engine, and moving said intermediate gear axially rearward together with said pinion by means of said movement linking body after said engine has been started to release said intermeshing of said intermediate gear with said ring gear, wherein:

said pinion comprises:

a first pinion flange portion disposed so as to protrude radially at a front end of said cylindrical pinion boss portion disposed on said pinion;

a second pinion flange portion disposed so as to protrude radially facing said first pinion flange portion from an opposite side of said pinion boss portion; and said movement linking body comprises:

first and second engaging recess portions fitting together with said pinion boss portion and said intermediate gear boss portion;

a first sliding surface coming into contact with said first pinion flange portion, said first sliding surface restricting rearward movement of said pinion;

a second sliding surface coming into contact with said second pinion flange portion, said second sliding surface restricting forward movement of said pinion; and a third sliding surface coming into contact with said clutch cover, said third sliding surface restricting forward movement of said pinion.

2. The electric starter motor according to claim 1, wherein:

said movement linking body is made of a resin.

3. The electric starter motor according to claim 2, wherein:

said movement linking body is made of a resin to which has been added a lubricant constituted by at least one material selected from a group including carbon fiber and polytetrafluoroethylene.

4. The electric starter motor according to claim 1, wherein:

lugs for preventing incorrect assembly are formed on said movement linking body.

5. The electric starter motor according to claim 1, wherein said first and second engaging recess portions have outer peripheral openings that face in opposite directions.

6. The electric starter motor according to claim 5, wherein at least one of said recesses are u-shaped.

7. The electric starter motor according to claim 6, wherein both of said recesses are u-shaped and are provided in a common plane.

8. The electric starter motor according to claim 1, wherein said third sliding surface is disposed at a portion of said movement linking body which is thicker than a portion where said second sliding surface is disposed.

9. The electric starter motor according to claim 1, wherein said movement linking body engages with said cylindrical pinion boss portion at an area between said first and second pinion flange portions and is held between said first and second pinion flange portions.

10. The electric starter motor according to claim 1, wherein said movement linking body engages with said cylindrical pinion boss portion at least at two areas of said cylindrical pinion boss portion which diametrically oppose each other.

* * * * *